US009162796B2

(12) United States Patent
Bratsch

(10) Patent No.: US 9,162,796 B2
(45) Date of Patent: Oct. 20, 2015

(54) LID OF A CONTAINER

(75) Inventor: Christian Bratsch, Salzburg (AT)

(73) Assignee: Xolution GmbH, München (DE)

( * ) Notice: Subject to any disclaimer, the term of this patent is extended or adjusted under 35 U.S.C. 154(b) by 897 days.

(21) Appl. No.: 13/138,449

(22) PCT Filed: Feb. 22, 2010

(86) PCT No.: PCT/EP2010/052192

§ 371 (c)(1),
(2), (4) Date: Aug. 29, 2011

(87) PCT Pub. No.: WO2010/094793

PCT Pub. Date: Aug. 26, 2010

(65) Prior Publication Data

US 2011/0315684 A1 Dec. 29, 2011

(30) Foreign Application Priority Data

Feb. 23, 2009 (AT) ..... A 300/2009

(51) Int. Cl.

| | |
|---|---|
| ***B65D 51/18*** | (2006.01) |
| ***B65D 17/00*** | (2006.01) |
| ***B65D 47/24*** | (2006.01) |

(52) U.S. Cl.

CPC ..... *B65D 17/166* (2013.01); *B65D 47/249* (2013.01); *B65D 2251/1066* (2013.01); *B65D 2517/004* (2013.01); *B65D 2517/0046* (2013.01)

(58) Field of Classification Search

CPC .. B65D 47/265; B65D 17/166; B65D 47/249; B65D 2251/1066; B65D 2517/004; B65D 2517/0046

USPC ..... 220/254.4, 270, 254.9, 281, 715, 714, 220/719, 849, 825, 508, 258.1, 554.3, 282

See application file for complete search history.

(56) References Cited

U.S. PATENT DOCUMENTS

| | | | |
|---|---|---|---|
| 3,889,842 | A | 6/1975 | Bennett |
| 4,122,971 | A | 10/1978 | Potts |

(Continued)

FOREIGN PATENT DOCUMENTS

| | | |
|---|---|---|
| DE | 2331284 | 1/1974 |
| DE | 4200614 | 3/1993 |

(Continued)

OTHER PUBLICATIONS

English Abstract of DE19613246.

(Continued)

*Primary Examiner* — Fenn Matthew
*Assistant Examiner* — Chetan Chandra
(74) *Attorney, Agent, or Firm* — Dykema Gossett PLLC

(57) ABSTRACT

The invention relates to a lid (8) of a container, especially a beverage can, comprising a substantially flat lid surface (9) and a preferably folded edge area, with at least one re-closeable pouring opening (10) being provided on the lid surface (9), and a substantially integral closure means (1) provided on the bottom side of the lid surface (9), which closure means is associated with the pouring opening (10) and is attached entirely to the bottom side of the lid surface (9) in a twist-proof manner, and an actuating means (6) which is in connection with the closure means (1), penetrates the lid surface (9) and is arranged accessibly from the outside on the upper side of the lid surface (9), with the closure means (1) being movable from a closed position to an open position through actuation of the actuating means (6), and with the actuating means (6) comprising a support element (12, 12', 14, 15) which cooperates with the lid surface (9) when the closure means (1) is in the open position, with the closure means (1) being movable to the open position from the closed position substantially perpendicularly to the lid surface (9) and the actuating means (6) covering the pouring opening (10) in the closed position.

12 Claims, 16 Drawing Sheets

(56) References Cited

U.S. PATENT DOCUMENTS

| | | | | |
|---|---|---|---|---|
| 4,345,695 | A | 8/1982 | Galloway et al. | |
| 4,746,032 | A | 5/1988 | Huang et al. | |
| 5,072,849 | A * | 12/1991 | Blau | 220/253 |
| 5,810,189 | A | 9/1998 | Baker | |
| 6,427,861 | B1 * | 8/2002 | Cho | 220/269 |
| 6,626,314 | B1 * | 9/2003 | McHenry et al. | 220/254.2 |
| 6,763,963 | B1 | 7/2004 | Martin | |
| 7,823,740 | B2 * | 11/2010 | Perra | 220/254.4 |
| 7,918,359 | B2 | 4/2011 | Paris et al. | |
| 7,934,616 | B2 * | 5/2011 | Felber | 220/259.2 |
| 8,118,184 | B2 * | 2/2012 | Ruse, Jr. | 220/254.4 |
| 8,720,740 | B2 * | 5/2014 | Bratsch | 220/821 |
| 2004/0226951 | A1 * | 11/2004 | Talmon | 220/257.2 |
| 2005/0115969 | A1 | 6/2005 | Mizuma | |
| 2007/0017937 | A1 | 1/2007 | Berthelin et al. | |
| 2008/0156802 | A1 | 7/2008 | Yauk et al. | |
| 2010/0102060 | A1 * | 4/2010 | Ruse, Jr. | 220/254.9 |
| 2011/0315684 | A1 * | 12/2011 | Bratsch | 220/258.2 |
| 2013/0320013 | A1 * | 12/2013 | Bratsch | 220/270 |

FOREIGN PATENT DOCUMENTS

| | | |
|---|---|---|
| DE | 19613246 | 10/1997 |
| DE | 19706112 | 4/1998 |
| DE | 19746539 | 3/1999 |
| DE | 20319105 | 4/2004 |
| EP | 0340835 | 11/1989 |
| EP | 0433502 | 6/1991 |
| EP | 1190952 | 9/2001 |
| EP | 1247752 | 10/2002 |
| WO | 9529101 | 11/1995 |

OTHER PUBLICATIONS

English Abstract of DE19706112.
English Abstract of DE19746539.
English Abstract of DE20319105.

* cited by examiner

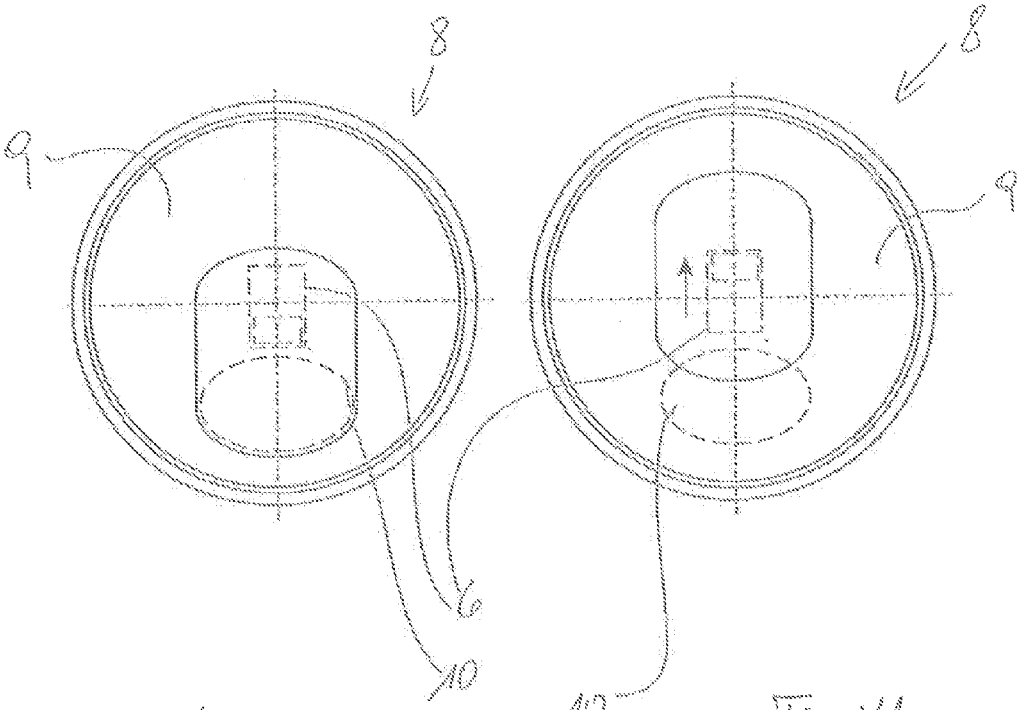
Fig 11a Fig 11b
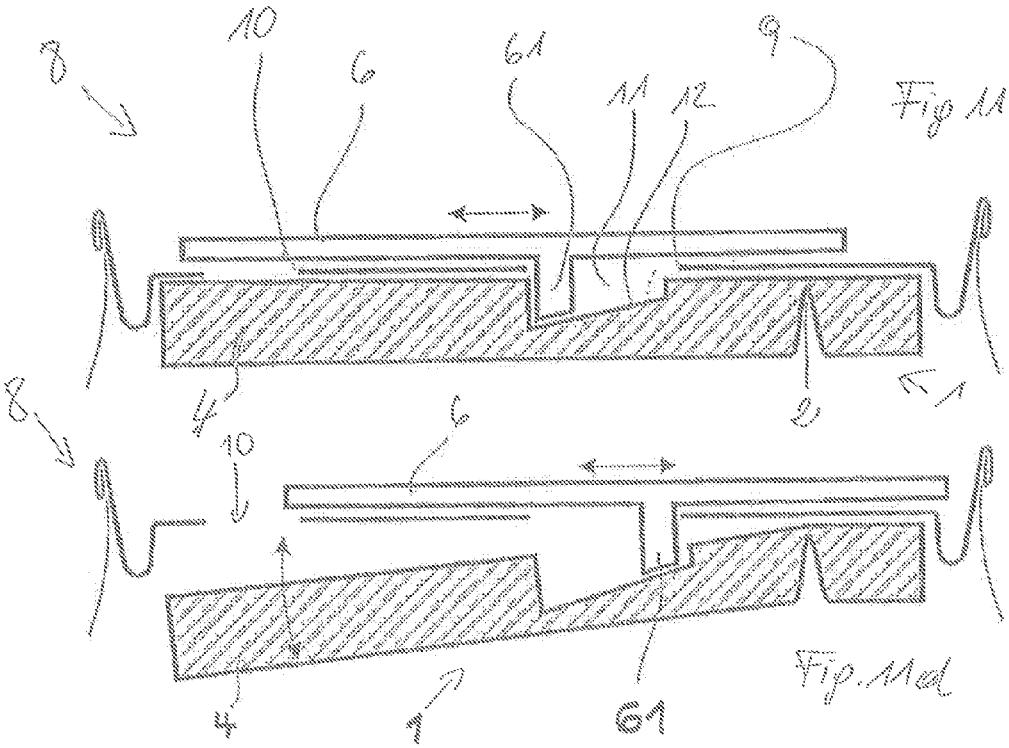
Fig 11c
Fig. 11d

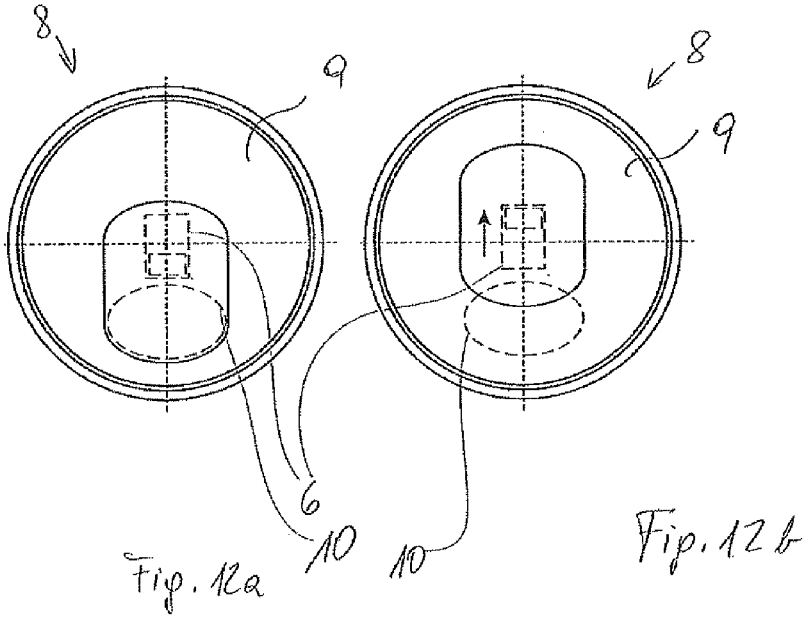
Fig. 12a
Fig. 12b
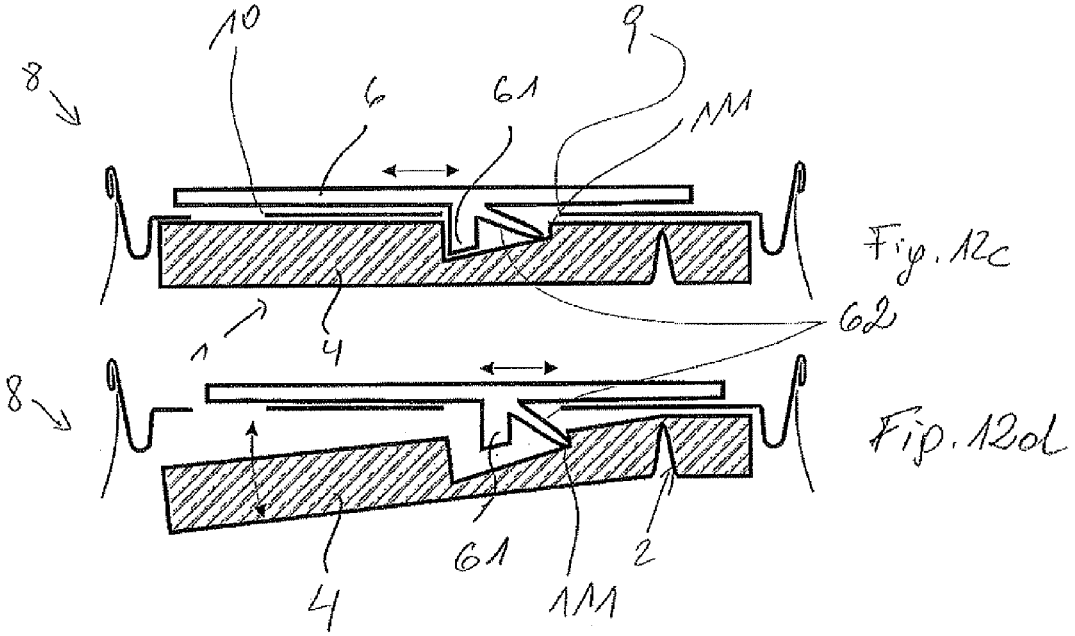
Fig. 12c
Fig. 12d 8
6
61
1

8
6
61
1

8
6
61
1

6
61
4

LID OF A CONTAINER

BACKGROUND OF THE INVENTION

1. Field of the Invention

The invention relates to a lid of a container, especially a beverage can, comprising a substantially flat lid surface and a preferably folded edge area, with at least one re-closeable pouring opening being provided on the lid surface, a substantially integral closure means associated with the pouring opening being provided in its entirety on the bottom side of the lid surface in a torsion-proof manner, and an actuating means which penetrates the lid surface being arranged on the upper side of the lid surface accessible from the outside, with the closure means being movable from a closed position to an open position through actuation of the actuating means, and with the actuating means comprising a support element which cooperates with the lid surface when the closure means is in the open position.

2. The Prior Art

Numerous beverage cans have become known which have a re-closable pouring opening. DE 196 13 246 A1 for example discloses a closure means with substantially the same diameter which is applied to the already existing lid, which closure means closes a pouring opening disposed in the lid by twisting. Similar apparatuses where some of these closure means cover the lid only partly have been described in DE 196 13 256 B4, DE 197 06 112 C2, EP 1 247 752 B1 or U.S. Pat. No. 6,626,314 B1. The disadvantageous aspect in these closure means is their mostly complex arrangement which additionally requires constructional changes to the lid region of the can.

A further group of closure means for beverage cans consists of a pull tab which is fastened by means of a rivet connection to the can lid, with the handle part of the pull tab being arranged simultaneously as the closure means for the pouring opening, which after the opening of the pouring opening seals the pouring opening again by twisting and/or folding down the pull tab. Such elements are shown, among other things, in DE 197 46 539 A1, DE 203 19 105 U1, EP 1 190 952 A2, EP 1 097 086 B1 and EP 0 433 502 A1. These beverage cans all have a closure means which is applied from the outside to the pouring opening and partly protrudes beyond the lid edge, so that the same can be removed inadvertently and the content of the can is exposed to the ambient environment.

GB 2 331 284 A finally describes a closure system, consisting of a pull tab for exposing a pouring opening and a closure means which is arranged on the bottom side of the lid of the can in the interior of the can, with a spring element pressing the closure means against the pouring opening. In order to enable the emptying of the can, parts of the closure means must be displaced against the pull tab. This closure means comes with the disadvantage that it is highly complex and requires a change to the conventional lid of the can. A slightly simpler arranged closure device which also consists of several parts is disclosed in U.S. Pat. No. 3,889,842, which also requires a complex changed lid. Similar re-useable closure means are described in U.S. Pat. No. 4,746,032 A and U.S. Pat. No. 4,345,695 A.

It is therefore the object of the invention to eliminate the disadvantages of the state of the art as described above and to provide a lid for a can which has a secure closure system for resealing the can which can preferably be mounted in a simple and cost-effective way in conventional lids.

SUMMARY OF THE INVENTION

This object is achieved in accordance with the invention by a lid of kind mentioned above in such a way that the closure means can be moved from the closed position to the open position substantially perpendicularly to the lid surface and that the actuating means covers the pouring opening in the closed position. In order to securely transport the can after the first opening of the same without releasing the remaining content of the can by inadvertent pressing of the closure means, the actuating means covers the pouring opening in the closed position in a further preferred embodiment of the invention. It is thus prevented that during the transport of the re-closed can in a bag, further objects disposed in the bag can move the closure means from its closed position to an at least partly open position and the content of the can will pour into the bag.

In a preferred embodiment of the invention, the closure means comprises a fastening part which is in connection with the lid surface in a non-detachable manner, and a closure area which seals the pouring opening in a liquid-tight manner, with a joint being provided between the fastening part and the closure area, about which the closure area of the closure means can be swiveled against a restoring force, and the joint is arranged as an area with increased flexibility disposed between the fastening part and the closure area. This joint is arranged in an especially simple and cost-effective embodiment of the invention as a region with a low cross section of the material disposed between the fastening part and the closure area. When the closure means is made of an elastic material, especially a resiliently flexible one, the closure means is folded away upon actuation of the actuating means, with a respective force needing to be employed which corresponds to the elastic properties of the material of the closure means.

By attaching the preferably integral closure means in a torsion-proof manner, e.g. by gluing or soldering to the bottom side of the lid surface, rapid mounting of the closure means on a conventional lid is enabled, with hardly any changes being required to the lid, or only slight ones, e.g. by simple punching of the lead-through of the actuating means through the lid. Especially the edge region of the lid remains unchanged, so that the placement and fixing of the lid on the container, especially the can, can occur in the conventional manner.

In a preferred embodiment of the invention, the actuating means is twistable substantially in one plane parallel to the lid surface. It is alternatively displaceable thereto. As a result of the movement of the actuating means, the closure means is moved away from the pouring opening on the one hand, with the same being moved preferably substantially perpendicularly from the closed position especially by being flipped away into the interior of the can, and on the other hand the actuating means releases the pouring opening itself.

It is especially simple to produce and thus cost-effective if the closure means is arranged as a two-component injection-molded part.

The actuating means which is in connection with the closure means, which actuating means can also be arranged integrally with the closure means for example, ensures on actuation that the closure means is flipped away from the plane of the pouring opening into the interior of the can, which means it is movable in a substantially perpendicular way relative to the lid surface to the open position. The pouring opening is thus released and the content of the can is thus removable.

In order to avoid having to provide a continual action of force on the closure means during the emptying of the can, the holding element of the actuating means is advantageously arranged as a latching nose for accommodating at least one edge of the lid surface in the open position of the closure means. The closure means is thus fixed in the open position and the content of the can can be removed without having to exert any additional force on the actuating means. Alternatively, the closure means can be held in the open position by a latching joint.

The actuating means can be arranged in different ways. It is shaped in the form of a wedge in a preferred embodiment. The wedge surface can be in a straight line or curved in the manner of a screw.

In another embodiment of the invention, the actuating means is arranged to be twistable on the top of the lid surface, substantially about a central axis extending substantially perpendicularly to the lid surface. It acts upon the closure means when twisted, so that the closure area is swiveled to the open position.

In a further variant of the invention, the actuating means is arranged as a lever with a latching nose, which lever protrudes upwardly in a perpendicular way from the lid surface.

Improved sealing of the pouring opening by the closure means is given when an additional sealing means can be arranged between the closure area of the closure means and the lid surface. It can be arranged for example on the side of the closure means facing the pouring opening. Similarly, it can be attached to the bottom side of the lid surface, with the same advantageously enclosing the edges of the pouring opening in order to prevent injuries while drinking from the can.

Preferably, the sealing means simultaneously forms the region made of elastic material, so that the number of individual parts of the lid is thus reduced and a higher stability of the closure means of the pouring opening of a beverage can is thus achieved in accordance with the invention.

An important aspect especially in food product packaging is packaging safety. This shall mean within the scope of this disclosure the protection with which the content of the food package, which in this case is the content of the beverage can, is protected from manipulation or removal until it is opened by the consumer. Therefore, the pouring opening is preferably closed off with a seal before the first opening. This seal is in the simplest of cases a tab or a label which covers the pouring opening and needs to be removed before the content of the can can be removed.

In another embodiment of the invention, the seal is arranged as a pre-punched closure tab which is pulled off during the first opening of the container and exposes the pouring opening in the lid surface.

The pouring opening is sealed in a further variant before the first opening with the closure means, with the actuating means having a securing device. The actuating means can be provided for example with a label which covers the lid surface at least partly, so that the label will tear upon actuation of the actuating means and thus indicate a manipulation of the container.

The securing device is especially preferred which has a predetermined breaking point which is broken open upon the first opening of the container. When a label is used as a securing means for example, it may be removed entirely under certain circumstances and then reapplied to the container again without a recognizable difference to an untouched label when glancing only briefly at the container. A manipulation of the content of the container is thus not recognizable at first glance. In the case of a securing device with a predetermined breaking point however, it is not possible to hide the manipulation of the seal and it is therefore especially secure for the consumer.

In a further embodiment of the invention, a ventilation device is provided in addition to the pouring opening which can be sealed by the closure means together with the pouring opening. This ventilation device allows emptying the content of the can in an especially simple way without any interruption due to negative pressure in the beverage can.

It is especially cost-effective when the closure means and/or the actuating means are made of plastic. It is understood that the employed material must be compatible to foodstuffs when packaging for foodstuffs is used.

The invention will now be explained in greater detail by reference to non-limiting embodiments.

BRIEF DESCRIPTION OF THE DRAWINGS

FIGS. 11*a* to 11*d* show an alternative embodiment of the lid in accordance with the invention in the closed and open position in an oblique and sectional view;

FIG. 12*a* to FIG. 12*d* show a further embodiment of the lid in accordance with the invention in the closed and in the open position in a top and sectional view;

DETAILED DESCRIPTION OF THE PREFERRED EMBODIMENTS

Figure 1:
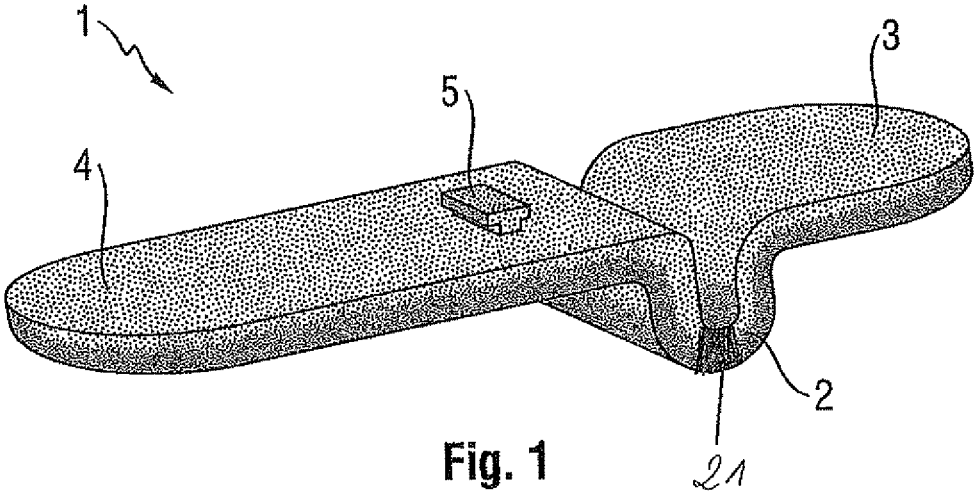
FIG. 1 shows a closure means in accordance with the invention.

As is shown in FIG. 1, the closure means according to the present invention is a substantially planar plate which is subdivided into two regions by an indentation 2. This indentation substantially represents a joint 2 which has an elastic region 21, with the closure means 1 especially being made as a two-component injection-molded part. The region with the smaller area is the fastening part 3 of the closure means 1 which is used for torsion-proof fastening of the closure means 1 to the bottom side of the lid of a container. In the region with the larger extension, which is the closure area 4, there is an attachment 5 which is T-shaped in its cross section and is integrally produced with the closure means 1. The closure means 1 is made in the illustrated embodiment of a resiliently flexible material, especially plastic.

Figure 2:
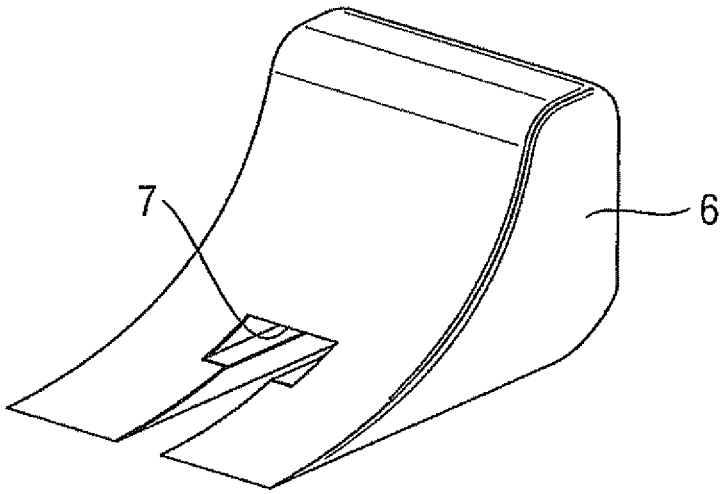
FIG. 2 shows a wedge-shaped actuating means.
Figure 3:
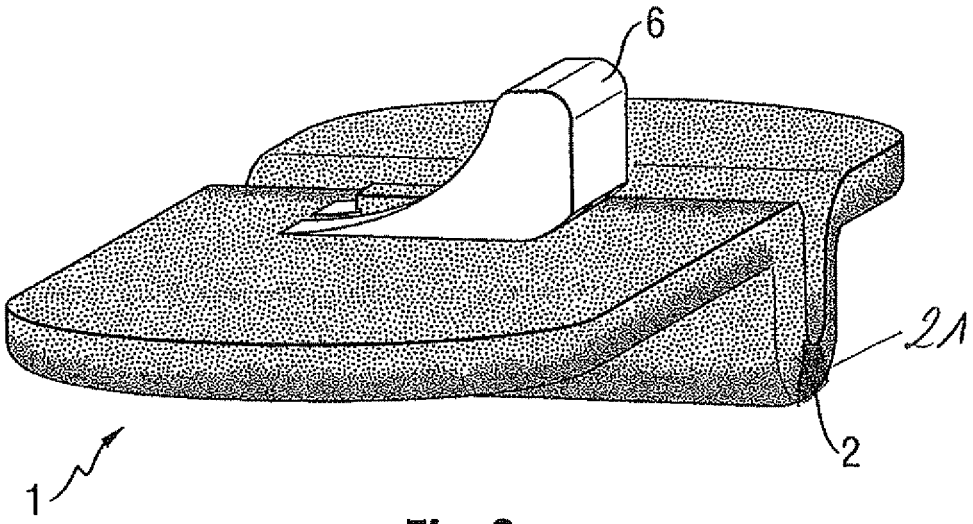
FIG. 3 shows the closure means of FIG. 1 with the wedge-shaped actuating means of FIG. 2.

A fastening means 6, which is arranged in a wedge-like manner according to FIG. 2, can be fastened to said attachment 5. For this purpose, the actuating means 6 comprises a recess 7, the cross section of which corresponds substantially to that of the attachment 5. FIG. 3 shows the closure means 1 with inserted actuating means 6.

Figure 4:
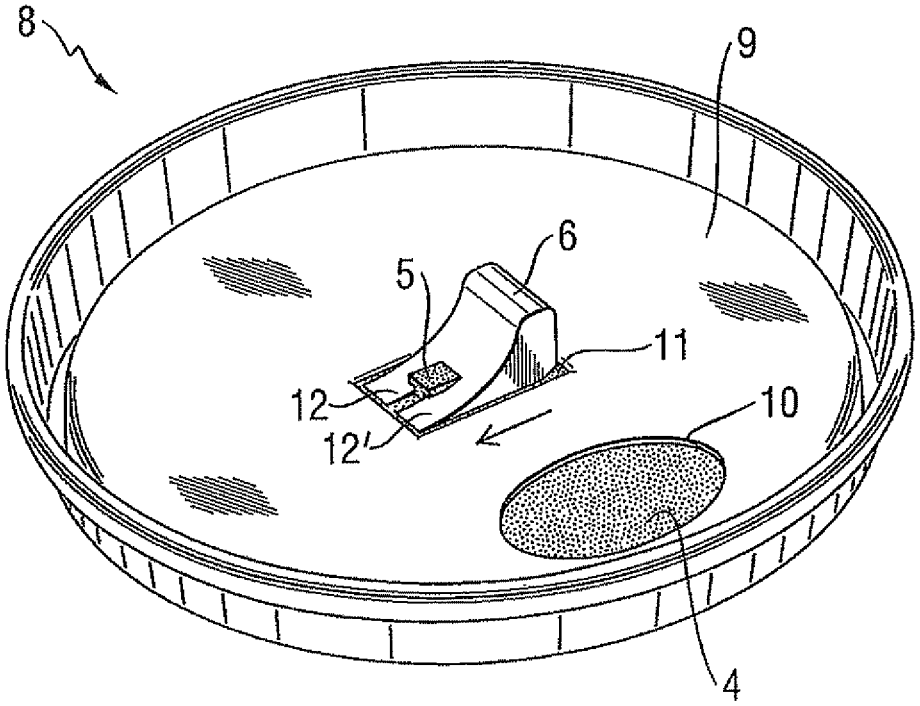
FIG. 4 shows a lid in accordance with the invention with the closure means of FIG. 3.

The closure means 1 is fastened in accordance with the invention to the bottom side of a container lid 8, especially to the bottom side of the lid surface 9 of a beverage can. The closure area 4 seals a pouring opening 10 which is arranged in an eccentric manner on the lid surface 9. The T-shaped attachment 5 protrudes through a recess 11 disposed in the central region of the surface 9 of the lid, on which the wedge-like actuating means 6 is placed. In order to expose the pouring opening 10 by swiveling the closure area 4 of the closure means 1 from the plane of the lid surface 9, the actuating means 6 is moved in the direction of the arrow according to FIG. 4 in such a way that the two legs 12, 12' slide between the lid surface 9 and the closure means 1. The elastic area 21 is used as a joint 2 which forms the swiveling axis of the closure area 4. The wedge-like actuating means 6 is moved simultaneously over the attachment 5 which engages in the receiver 7 of the actuating means 6.

As a result of the increasing cross section of the two legs 12, 12', the distance between the lid surface 9 and the closure means 1 increases, with the closure area 4 being swiveled about a swiveling axis disposed substantially in the indentation 2. The indentation 2 which is disposed in the closure means 1 thus acts as a joint, with the closure area 4 being swiveled about its axis out of the plane of the lid surface 9.

In the variant of the invention as shown in FIGS. 1 to 4, an additional closure element is provided which is arranged on the actuating means 6 and which is arranged on the side of the lid surface 9 which is opposite of the closure means 1 for closing the pouring opening 10. The illustration of the additional closure element was omitted for reasons of clarity of the illustration. Said closure element has a shape which is substantially adjusted to the shape of the pouring opening 10 and also releases the pouring opening 10 upon displacement of the actuating means 6.

Figure 5:
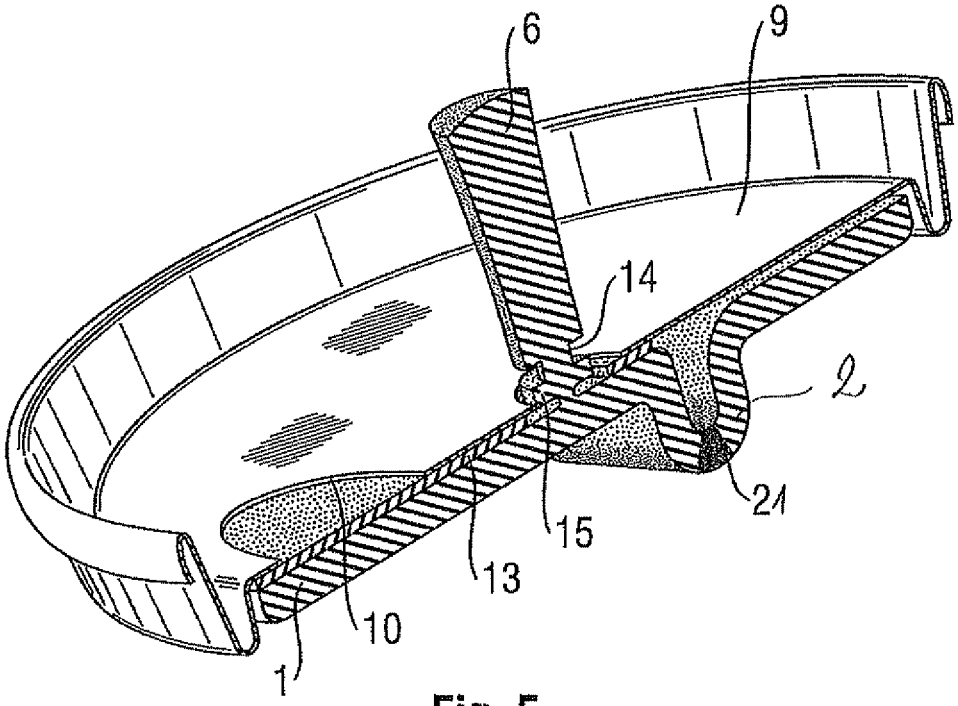
FIG. 5 shows a cross-sectional view of a lid with a further embodiment of the actuating means with sealed pouring opening.
Figure 6:
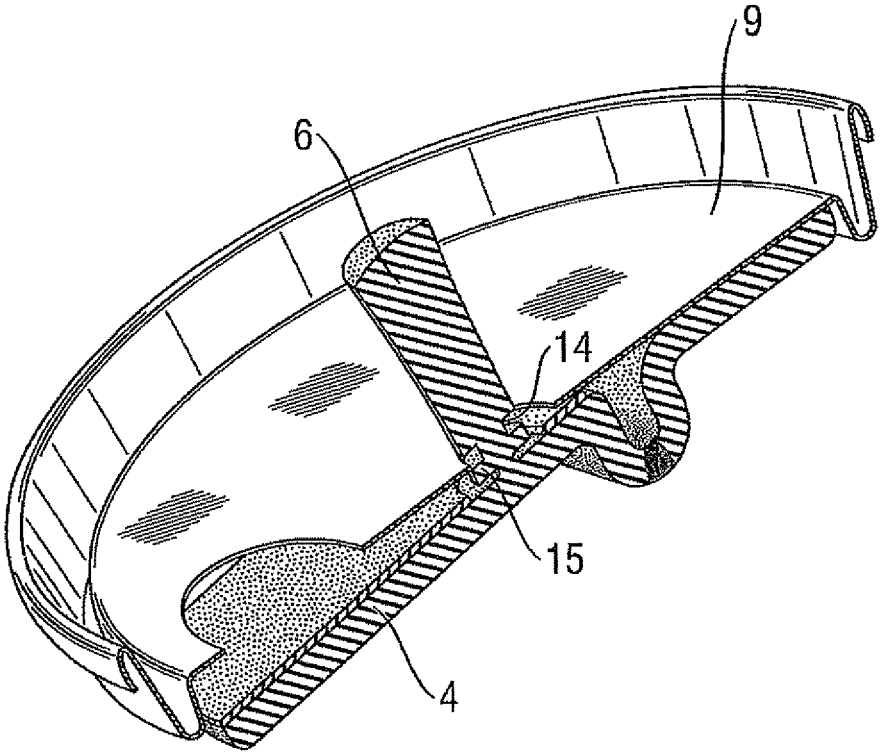
FIG. 6 shows the lid of FIG. 5 with the closure means in the open position.

FIG. 5 and FIG. 6 show a further embodiment of the invention. The closure means 1 is again arranged on the bottom side of the lid surface 9 in order to seal the pouring opening. 10 with its closure area 4. A sealing material 13 is arranged between the closure area 4 and the lid surface 9, which sealing material seals additionally and prevents the leakage of the content of the container. The closure means 1 is pressed against the pouring opening in the closed position as shown in FIG. 5 by a pretension resulting from the shape of the closure means made of elastic material on the one hand, and the pressing pressure increases further on the other hand when carbonated beverages are filled into the container for example. An elastic area 21 is further provided in the region of the joint 2, which elastic area supports the flipping away of the closure area 4 during actuation of the actuating means 6.

In this embodiment, the actuating means 6 is a substantially cylindrical lever which is connected with the closure means 1 through a bore in the lid surface 9. In this case, the lever is either made integrally with the closure means 1 or is fastened to the same via a screwed connection for example. The lever 6 comprises a constriction 14 at its bottom end facing the surface of the lid, adjacent to which there is a region 15 with the original diameter of the lever 6. When the lever 6 is pressed down, the closure means 1 moves towards the interior of the container, as shown in FIG. 6, and exposes the pouring opening 10. The region 15, which acts as a latching nose, slides here beneath the lid surface 9, whereas the edge of the lid surface 9 engages in the constriction 14. In this way, the closure area 4 is fixed in its position when folded away and the container can be emptied. In order to reseal the pouring opening 10, it is merely necessary to push the lever 6 in the direction opposite of the pouring opening, so that the edge of the lid surface 9 will slide out of the constriction 14 again and will release the latching nose again.

Figure 7:
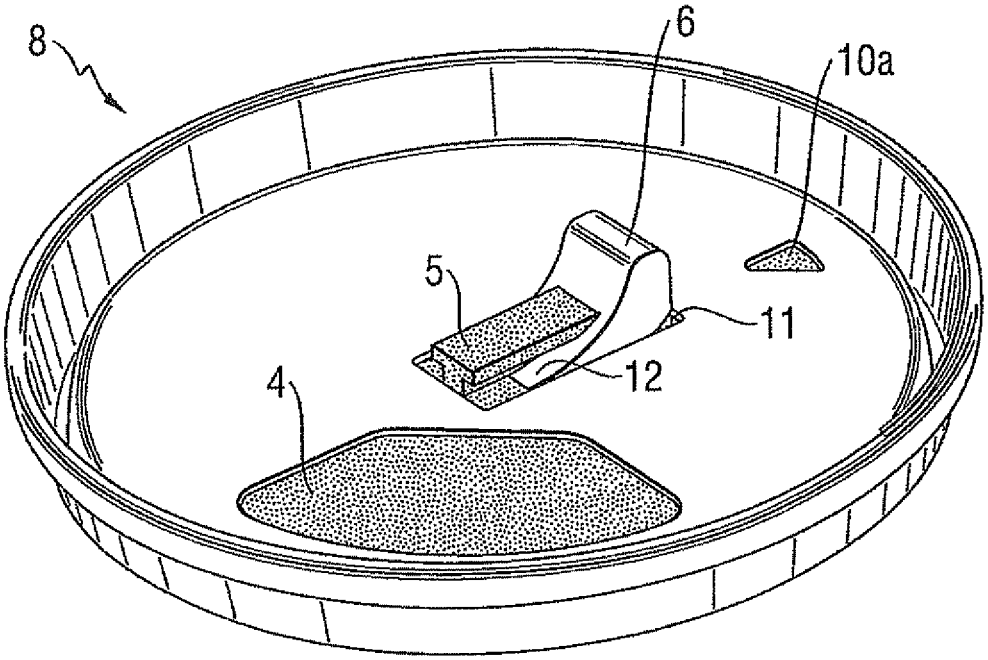
FIG. 7 shows an alternative embodiment of a lid in accordance with the invention in an oblique view from above.
Figure 8:
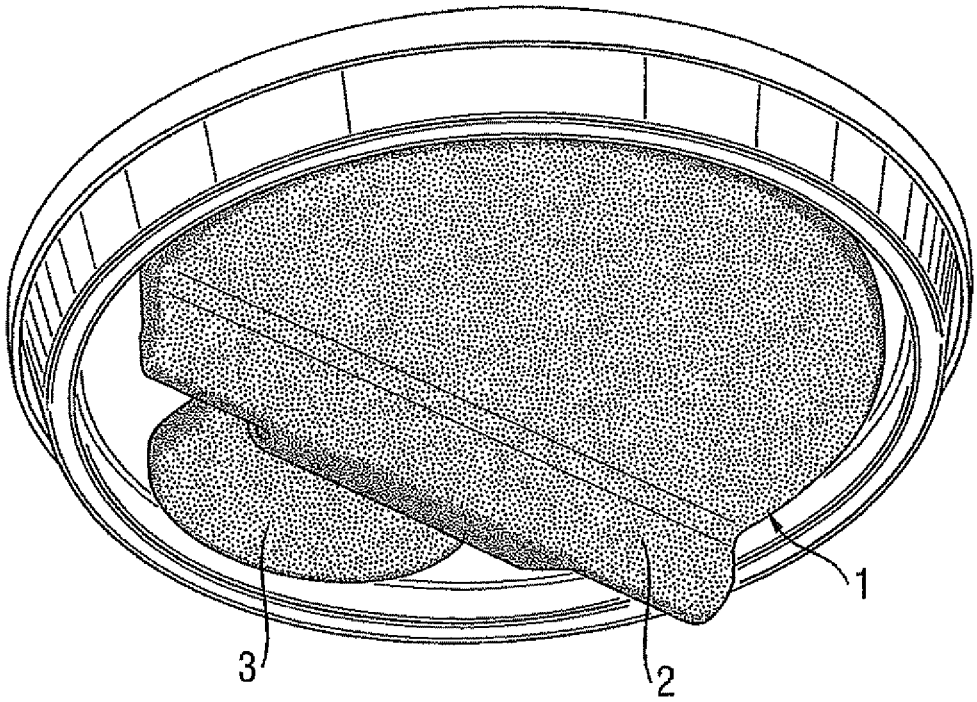
FIG. 8 shows the lid of FIG. 7 in an oblique view from below.

The lid of FIG. 7 and FIG. 8 differs from the lids as described above in such a way that an enlarged pouring opening 10 is arranged in a laterally offset manner and a ventilation opening 10*a* is additionally provided. Both openings 10 and 10*a* can be closed by a respectively arranged closure means 1. A further closure element is additionally arranged on the exterior of the lid surface 9 in an embodiment of the invention (not shown) and prevents any inadvertent swiveling of the closure area 4 during the transport of the beverage can in a bag for example.

The drawings show clearly that the closure means 1 is arranged merely in the region of the lid surface 9 and the edge region of the lid 8 remains free. For the purpose of mounting the closure means 1, it merely needs to be fastened with its fastening part 3 to the bottom side of the lid 8 in such a way that the closure area 4 completely covers the pouring opening 10. The actuating means 6 is then fastened to the closure means 1 through a recess 11 or bore disposed in the lid surface 9. The lid 8 can then be fastened to the container in the known manner without having to take special precautions or make changes to the machines used for this purpose.

Figure 9:
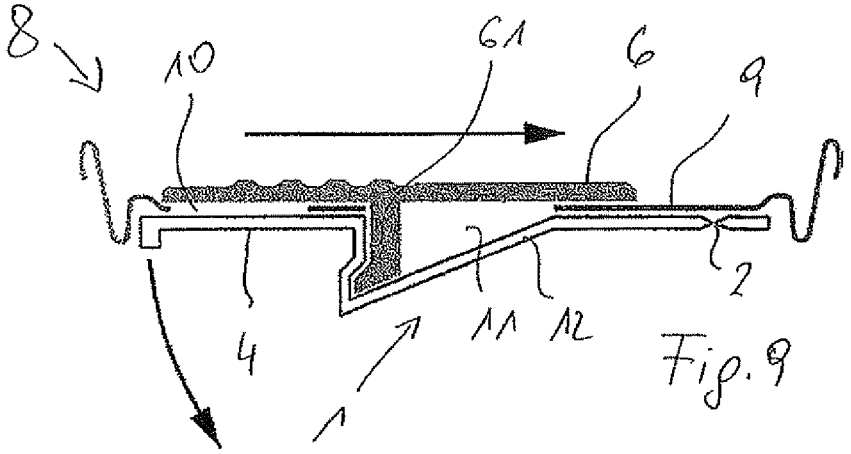
FIG. 9 shows a further embodiment of a lid in accordance with the invention in a sectional view.
Figure 10A:
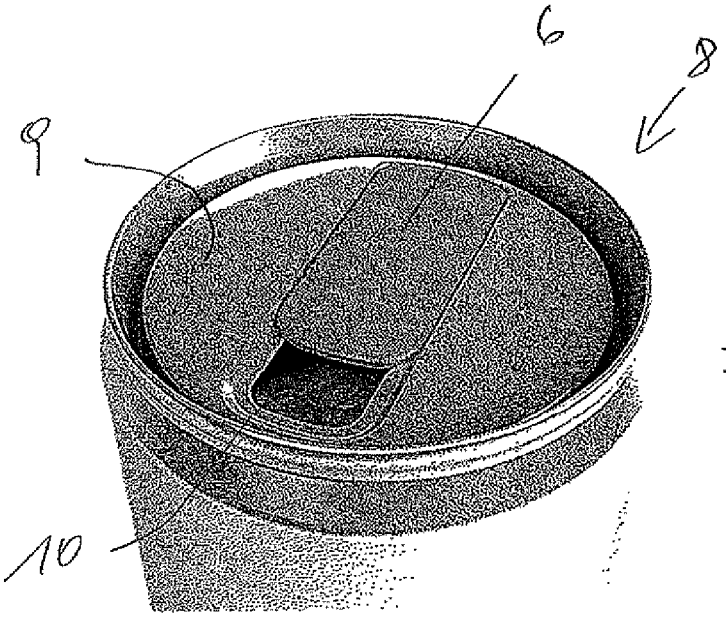
FIGS. 10*a* and 10*b* show an oblique view of the lid of FIG. 9.
Figure 10B:
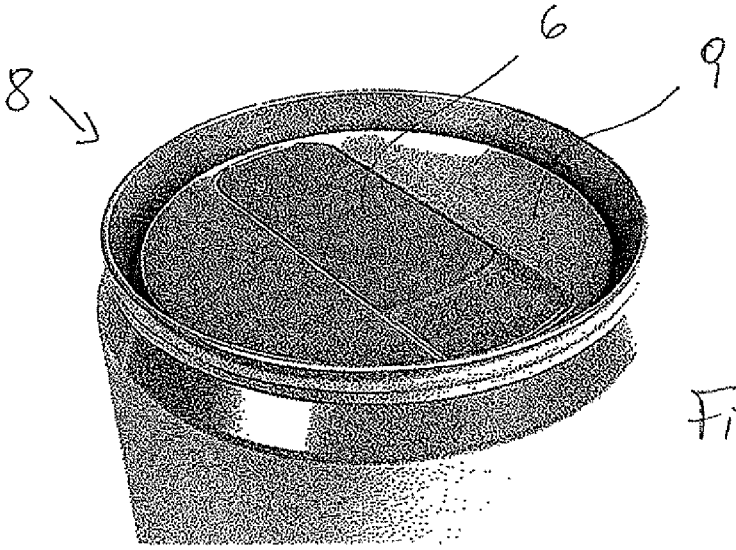

A further variant of the invention is shown in the FIGS. 9 to 10*b*. An actuating means 6 with a hook-like projection 61 which penetrates the lid surface 9 is arranged on the lid 8 of a beverage can. Projection 61 latches in the closed position (FIG. 9 and FIG. 10*b*) into a fitting recess 11 of the closure means 1 arranged beneath the surface of the can. In order to open the drinking orifice 10 by displacing the actuating means 6 in the direction of the arrow in a plane parallel to the lid surface 9, the projection 61 is moved along an inclined portion 12 of the recess 11, so that the closure area 4 of the closure means 1 moves along the curved arrow into the interior of the can, with the swiveling occurring via a joint 2 which is arranged as a region with a lower cross section of the material.

A schematic illustration of the closed position or open position of a similar embodiment of the invention is shown in FIGS. 11*a* to 11*d*. An actuating means 6 is provided again which is moved to an open position (FIG. 11*b* and FIG. 11*d*) from a closed position (FIG. 11*a* and FIG. 11*c*) by way of a translational displacing movement extending substantially parallel to the plane of the lid surface 9. A protrusion 61 of the actuating means 6 engages in a run-up slope 12 of a recess 11 of the closure means 1, by means of which the closure area 4 is pivoted into the interior of the can around the joint 2 which is arranged in this case as a thinned portion in the material. The run-up slope 12 can also comprise different areas with different inclines, so that at first a high action of force is generated on the closure means 1 by displacement of the actuating means 6 in order to overcome a potentially prevailing excess pressure in the beverage can, whereafter a lower action of force is achieved for completely exposing the pouring opening 10 by a lower inclination of the run-up slope. In the closed position, the actuating means 6 simultaneously also acts as an additional closure element for securing the pouring opening 10.

The embodiment of the lid 8 in accordance with the invention which is shown in FIG. 12*a* to FIG. 12*d* describes an actuation element 6, which in addition to the protrusion 61 comprises an elastic pressure element 62 which engages in an abutment 111, moves up in the manner of a hinge and produces a high opening path of the closure area 4 in combination with a small operating path of the actuating means 6. A high opening force for the ventilation during first-time opening of the beverage can can be produced in an especially simple way.

Figures 13A, 13B:
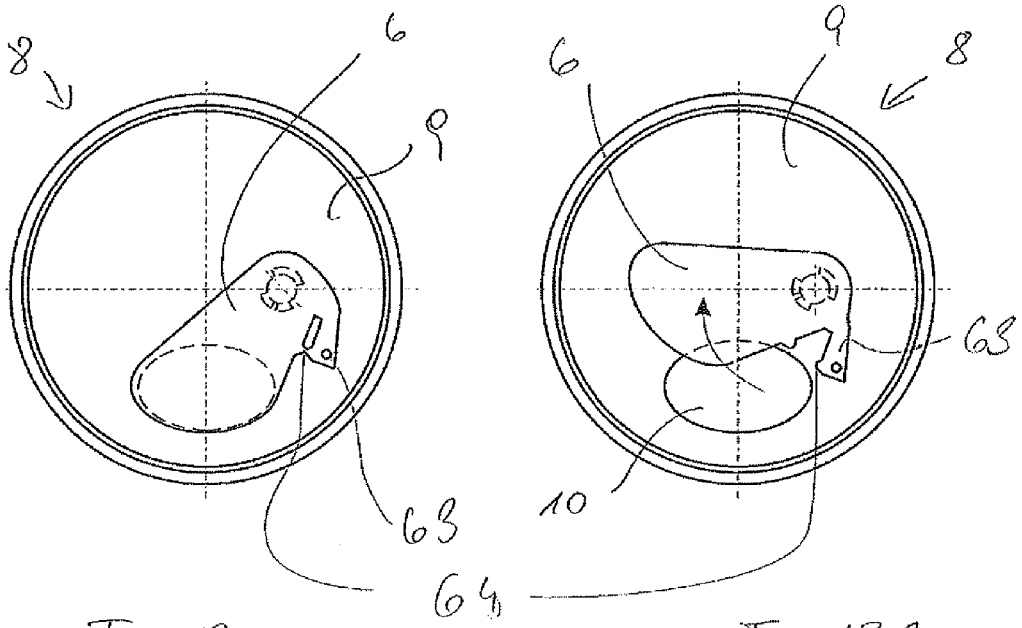
FIGS. 13*a* and 13*b* show a further embodiment of the lid in accordance with the invention in the closed and open position in a top view with a predetermined breaking point.

FIGS. 13*a* and 13*b* show a further embodiment of the invention, in which the actuating means 6 is pivoted about an axis normally to the lid surface 9, with a partial area 63 of the actuating means being non-detachably connected with the lid surface 9. When the actuating means 6 is moved for the first-time opening of the beverage can along the arrow (FIG. 13*b*), a predetermined breaking point 64 is severed. A securing element is therefore also obtained which indicates to the consumer whether the beverage can has already been opened.

Figure 14A:
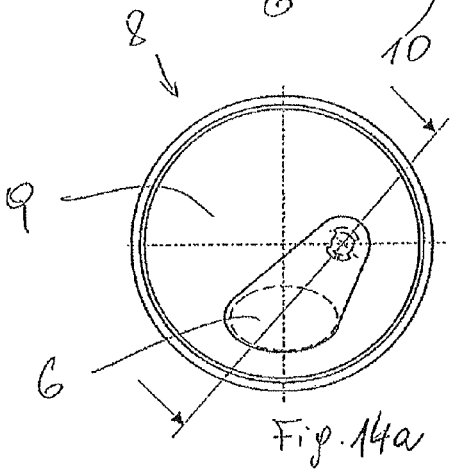
FIGS. 14*a* to 14*d* show a further embodiment of the lid in accordance with the invention in the closed and open position in a top view.
Figure 14B:
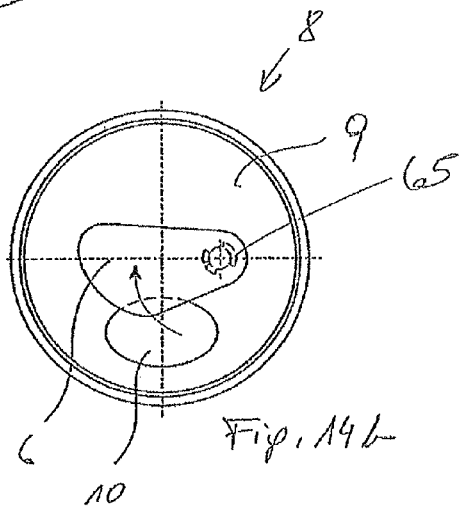
Figure 14C:
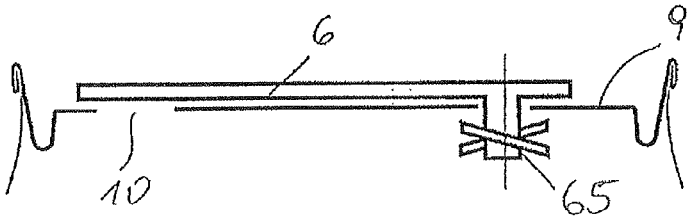
Figure 14D:
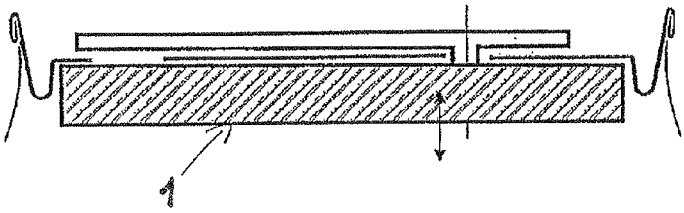
Figure 15A:
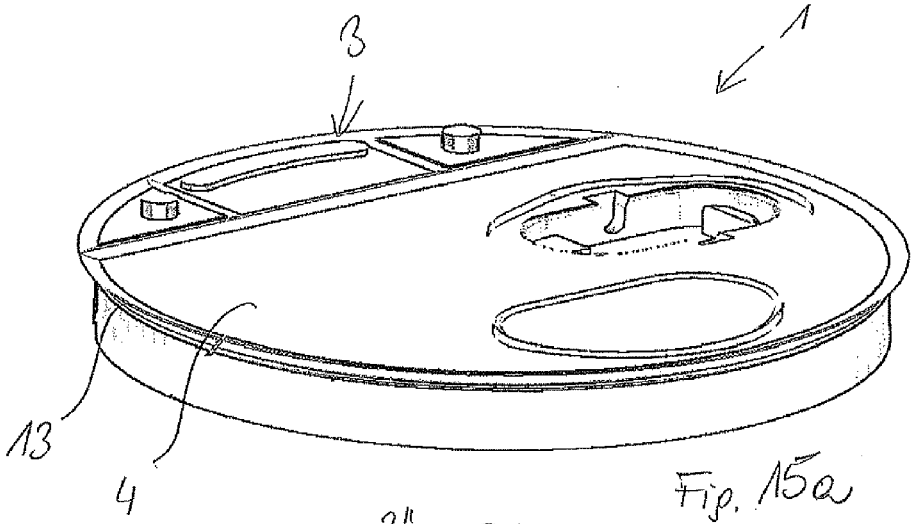
FIG. 15*a* shows a preferred embodiment of the closure means in accordance with the invention in an oblique view with sealing element.
Figure 15B:
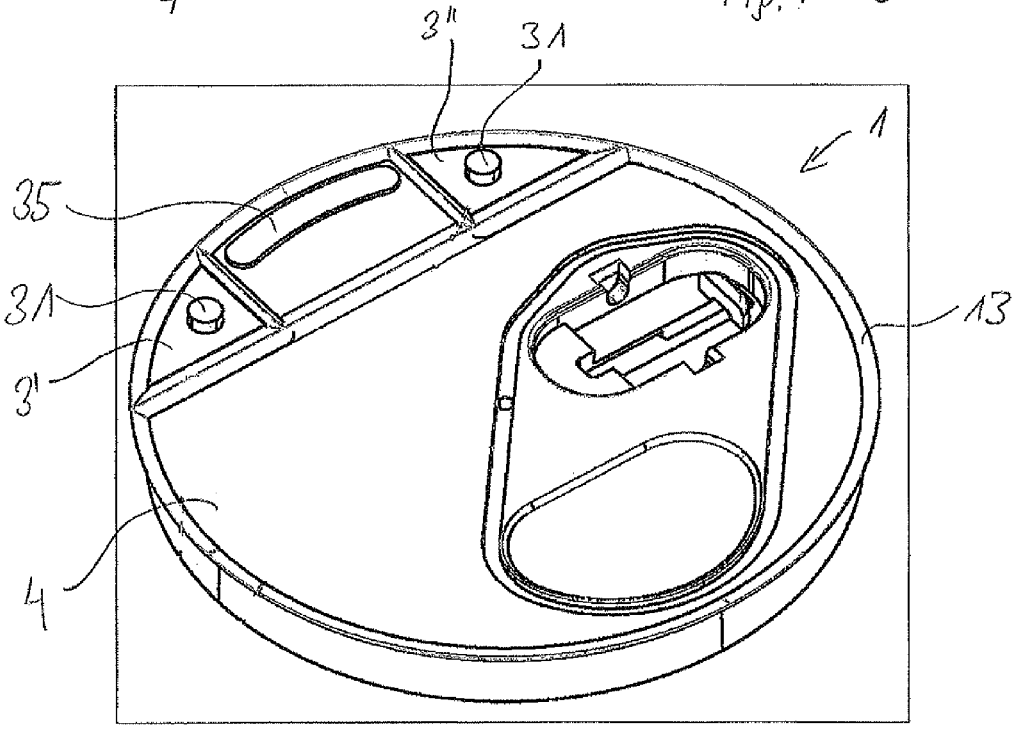
FIG. 15*b* shows a top view of the closure means of FIG. 15*a;*

An alternative embodiment of the lid 8 in accordance with the invention is shown in the FIGS. 14*a* to 14*c*, wherein the actuating means is also brought in a rotational movement from the closed position to the open position, with a helix 65 being provided for the vertical movement (arrow in FIG. 14*d*) of the closure means 1. The closure means 1 was not shown in FIG. 14*c* for reasons of clarity, as also the helix 65 in FIG. 14*d*.

The variant shown in FIG. 15*a* to FIG. 17*b* concerns a closure means 1 which is arranged as a two-component injection-molded part. The injection-molded part consists of a closure area 4 made of a substantially rigid material and tripartite fastening part 3, with the two outer fastening areas 3', 3" having an elevation 31, through which the closure means 1 can be connected with the surface 9 of the can. The middle part disposed between the two fastening areas 3', 3" forms a spring element 32 which returns to the closure area 4 to the closed position. A projection 35 is provided on the spring element 32 which causes the spacing of the spring element 32 relative to the surface 9 of the can, so that the pretension required for the closing of the pouring opening 10 is built up on closure area 4 of the closure means 1 which is preferably integrally arranged with the spring element 32.

Figure 16:
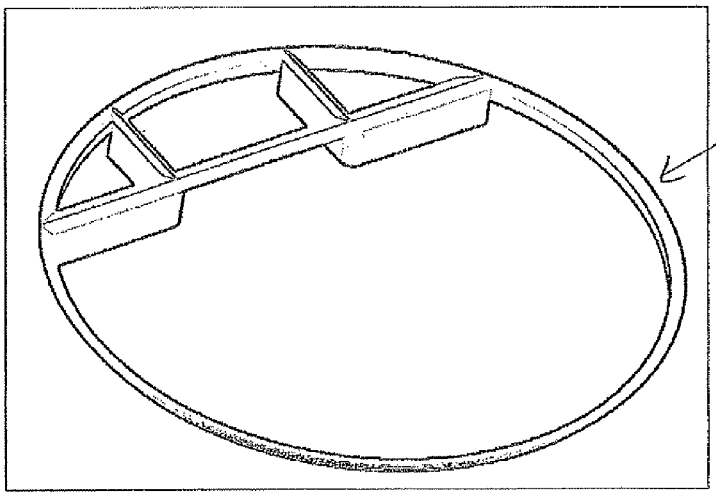
FIG. 16 shows an oblique view of the sealing element.
Figure 17A:
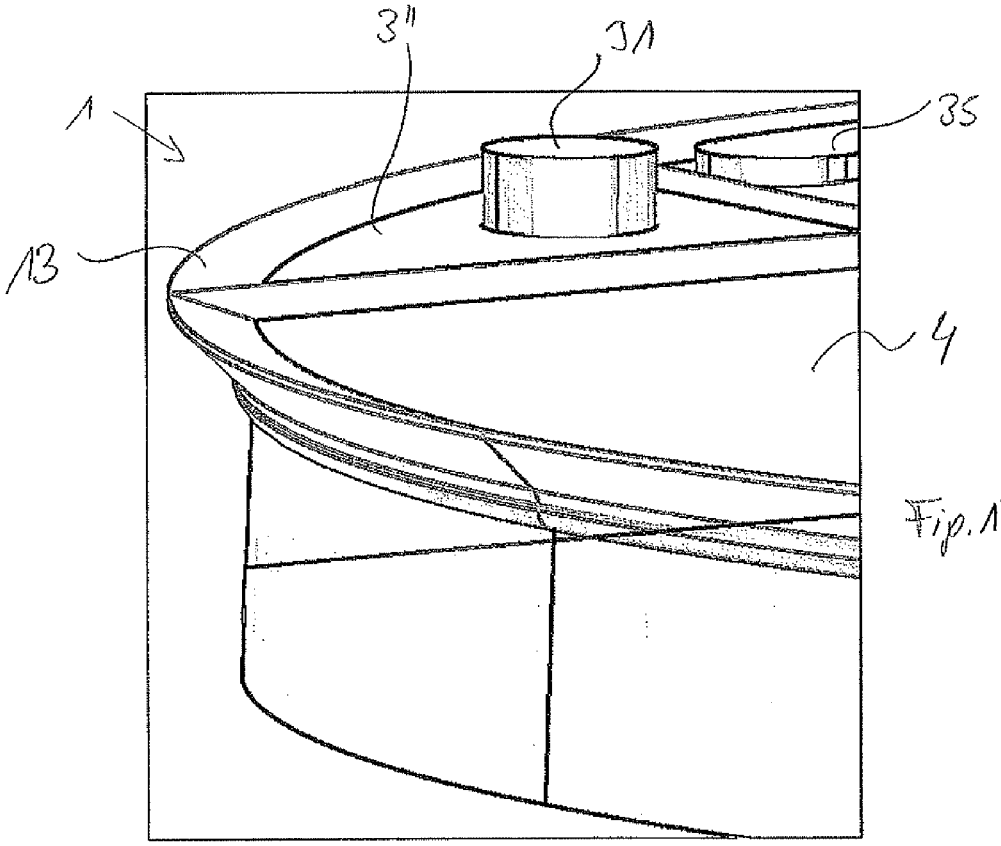
FIG. 17*a* shows an oblique view of an edge region of the closure means of FIG. 15*a;*
Figure 17B:
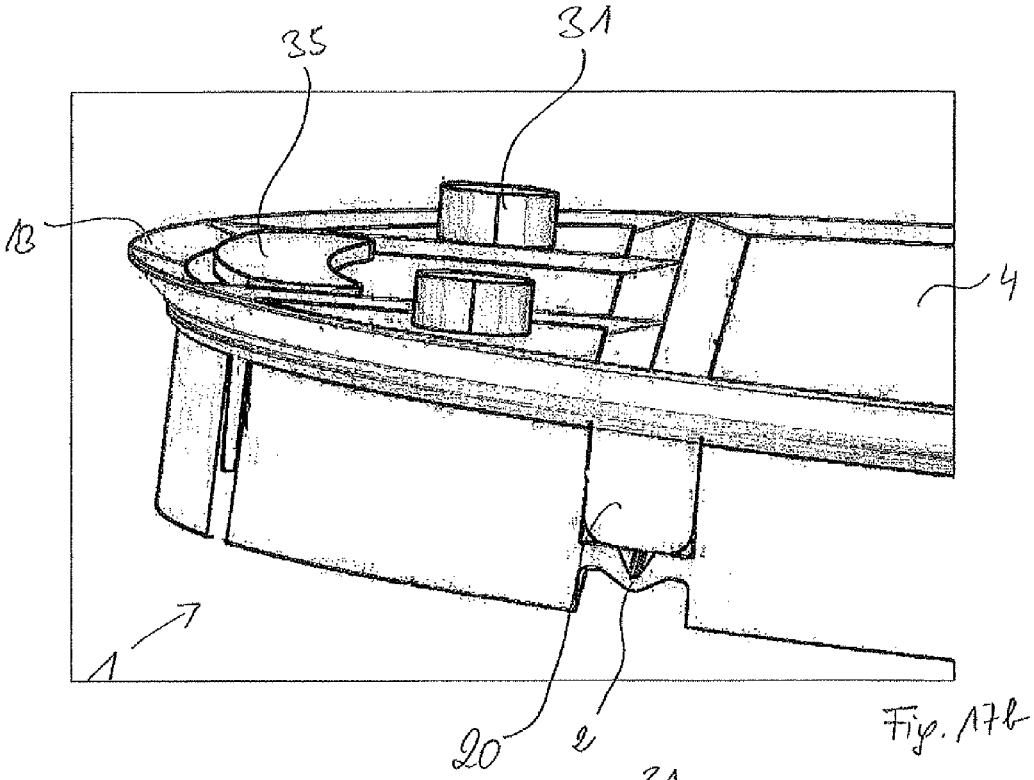
FIG. 17*b* shows an oblique view of a further edge region of the closure means of FIG. 15*a;*

The closure means 1 further comprises a sealing element 13 whose arrangement is shown especially in FIG. 16. On the one hand, said sealing element 13 made of a flexible material seals the closure means 1 against the edge of the lid 8 of the can, with said sealing element being arranged along the outside edge 13 of the closure means 1. On the other hand, it is arranged between fastening part 3 and closure area 4 and thus acts as a joint 20. In the embodiment shown in FIG. 17*b*, the closure means 1 additionally comprises an area 2 with reduced cross section of the material which also supports the swiveling of the closure area 4 into the interior of the can. In another variant of the invention, this area acts as a sole joint, so that fastening part 3 and closure area 4 are arranged as two separate parts (not shown).

Figure 18:
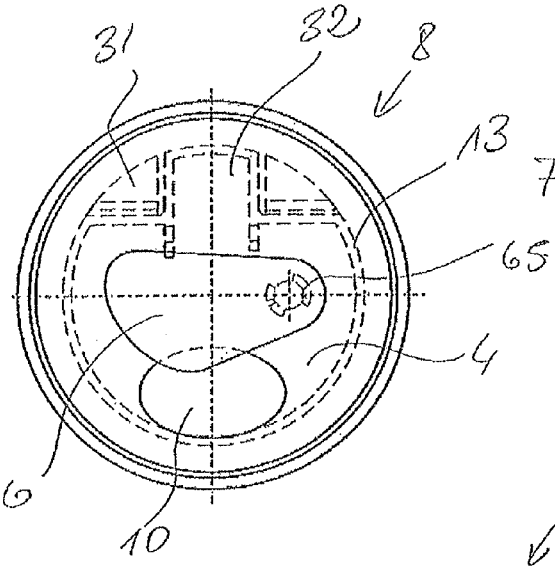
FIG. 18 shows a further variant of the lid in accordance with the invention with sealing element in a top view.

The variant of the lid 8 in accordance with the invention as shown in FIG. 18 comprises the previously discussed sealing element 13 and a twistable actuating element 6 which acts by way of a helix element 65 onto the closure means 1 which is arranged beneath the lid surface 9. The spring element 32 of the fastening area 3 is arranged integrally with the closure area 4 and thereby produces the required pretensioning of the closure area 4.

Figure 19A:
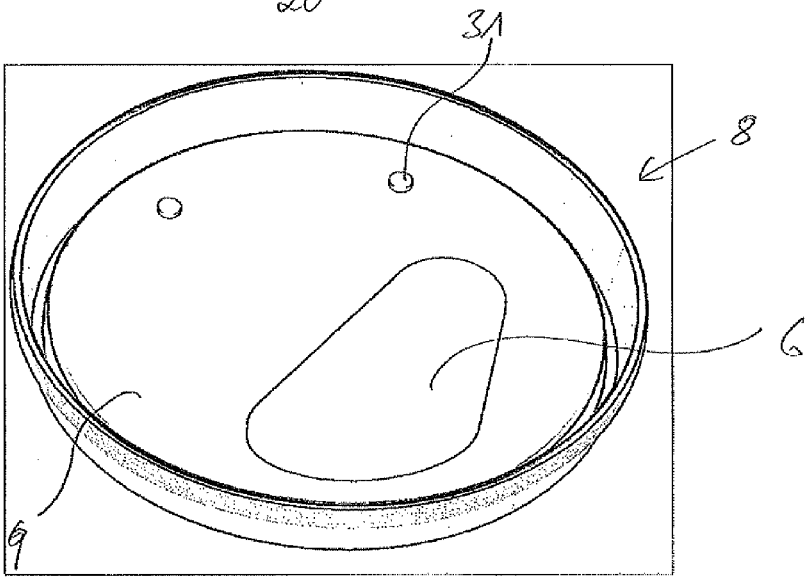
FIGS. 19*a* and 19*b* show an oblique view of a further embodiment of the lid in accordance with the invention.
Figure 19B:
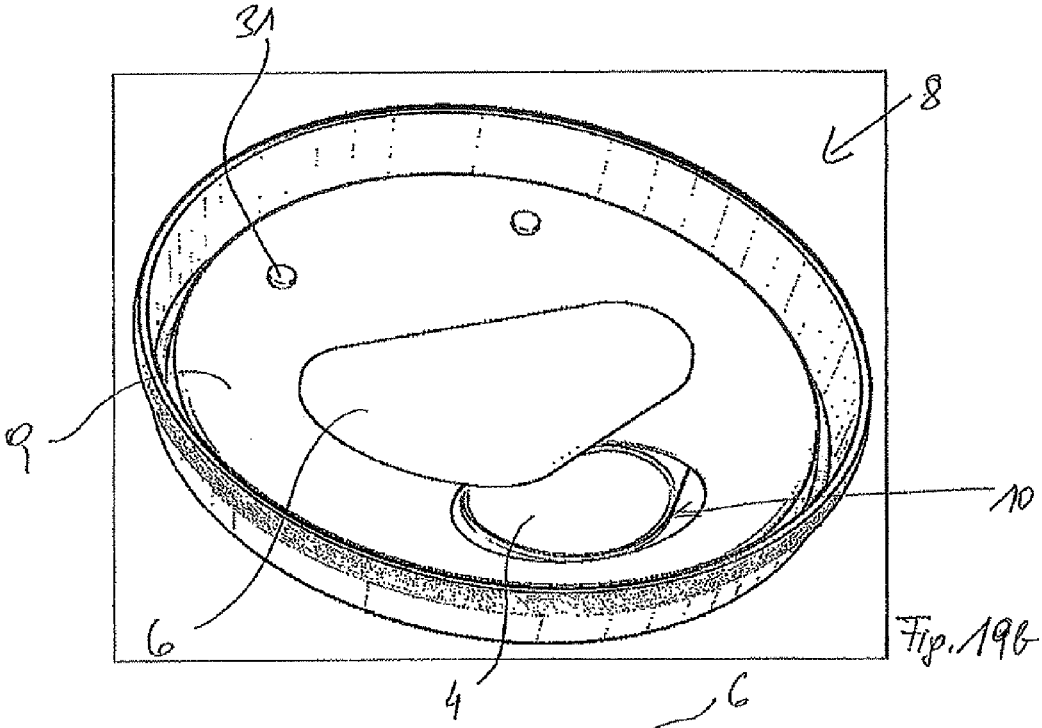
Figure 20:
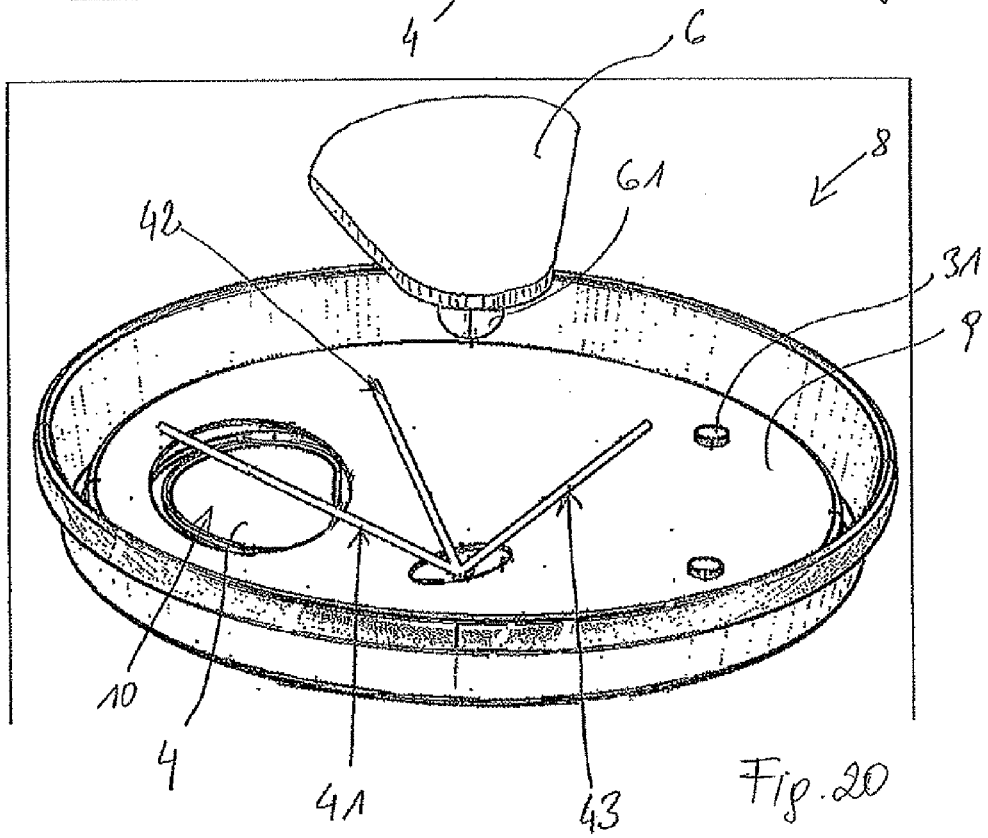
FIG. 20 shows a partly exploded oblique view of the lid of FIG. 19*a* and FIG. 19*b;*

FIGS. 19*a* to 20 show a further embodiment of the lid 8 in accordance with the invention with the associated actuating means 6, with the closure means 1 being arranged beneath the lid surface 9. The actuating means 6 is shown in FIG. 19*a* in the closed position, with the same simultaneously sealing the pouring opening 10. In FIG. 19*b*, the actuating means 6 is swiveled parallel to the plane of the surface 9 of the can in such a way that it releases the drinking orifice 10, but the closure area 4 of the closure means 1 is not yet flipped into the interior of the can. Following a further twisting of the actuating means 6 in a clockwise manner towards the fastenings 31 for example, a pin 61 protruding through the surface 9 of the can (FIG. 20) produces a swiveling of the closure area 4 into the interior of the can for exposing the drinking orifice 10. FIG. 20 again shows three positions of the actuating means 6 which is twistable in this embodiment of the invention along the surface of the can. In position 41 the actuating means 6 covers the pouring opening 10 entirely, so that the closure area 4 of the closure means cannot be pressed inadvertently into the interior of the can. The pouring opening 10 is exposed in position 42, but still sealed by the closure area 4 of the closure means 1. In position 43 the drinking orifice 10 has been exposed entirely and the content of the can can be removed.

Figures 21A, 21B, 22A, 22B:
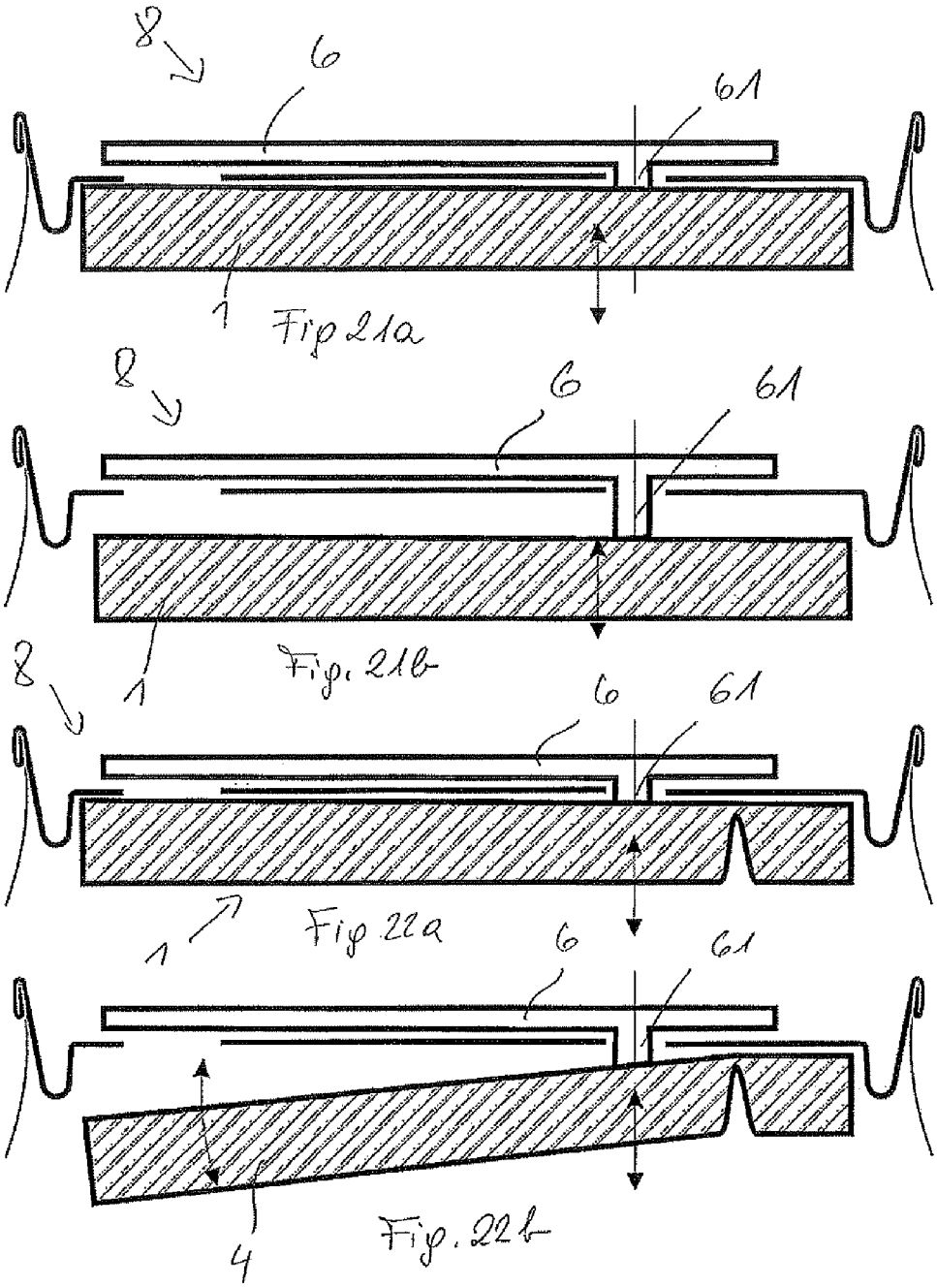
FIGS. 21*a* and 21*b* show a sectional view of a lid in accordance with the invention with a vertical opening mechanism.
FIGS. 22*a* and 22*b* show a sectional view of a lid in accordance with the invention with a hinge mechanism.

FIGS. 21*a* and 21*b* show an embodiment of the lid 8 in accordance with the invention, in which the actuating means 6 is pivoted away from the pouring opening 10 by twisting for example, while simultaneously a vertical force (double arrow) is exerted by way of a protrusion 61 on the closure means 1, which in this variant of the invention is arranged without a joint and therefore remains substantially parallel to the lid surface 9 during the vertical movement.

In contrast to this, in the variant as shown FIG. 22*a* and FIG. 22*b* the closure means 1 comprises a joint 2 which is formed in this case by a reduction of the cross section of the material, so that a tilting movement of the closure area 4 of the closure means 1 is achieved upon action of force on the protrusion 61.

Figures 23A, 23B, 24A, 24B, 24C:
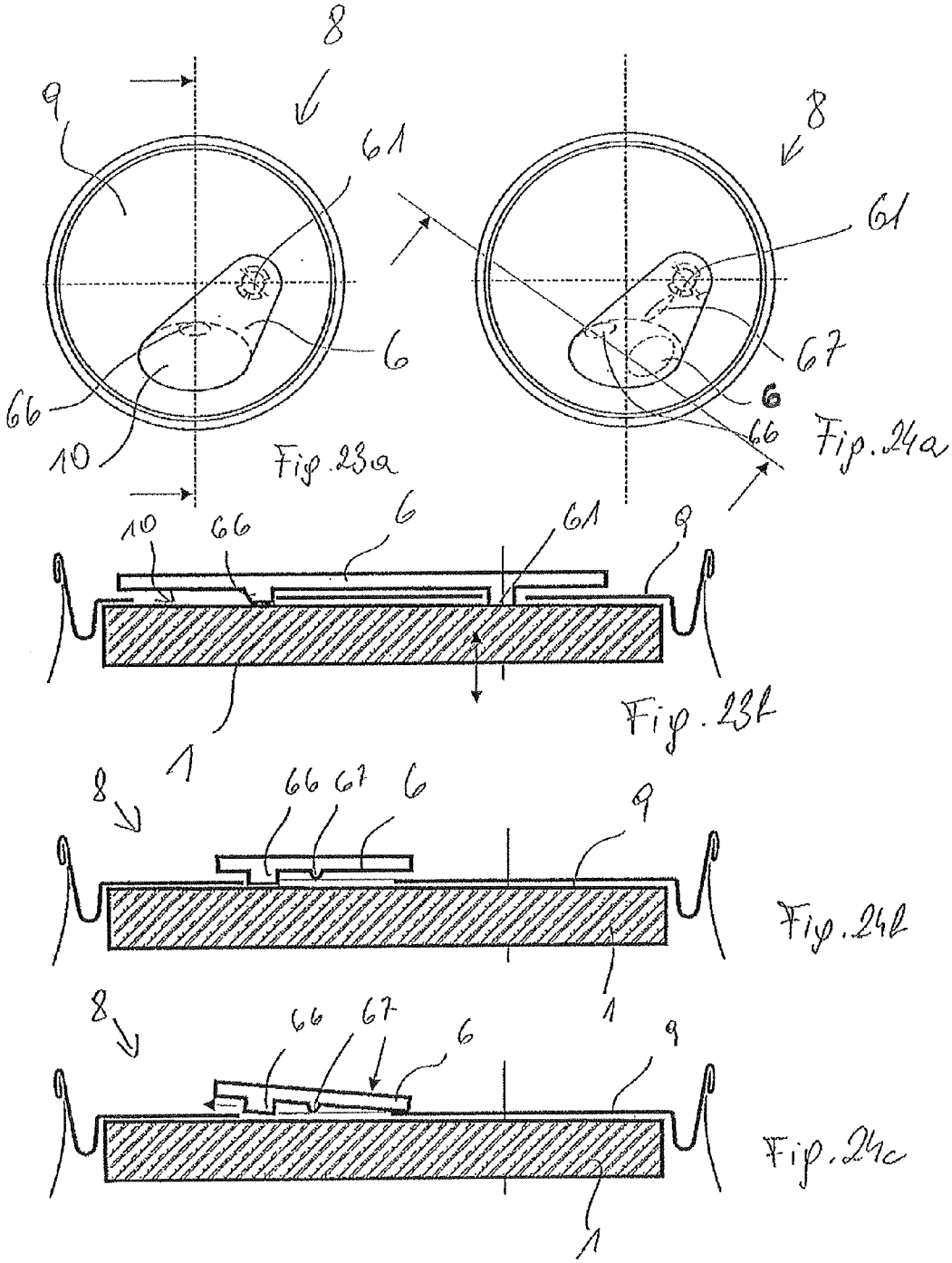
FIGS. 23*a* and 23*b* show a further embodiment of the lid in accordance with the invention in a top view and in a sectional view.
FIGS. 24*a* to 24*c* show a further embodiment of the lid in accordance with the invention in a top view and in two sectional views.

In the variant of the invention as presented in FIG. 23*a* and FIG. 23*b*, the actuating means 6 comprises a latching cam 66, which in the illustrated closing state latches into the pouring opening 10 and thereby fixes the actuating means 6 with increased resistance in this position. Similarly, it can be provided that the latching cam 66 will latch into a recess specifically provided in the lid surface of the can.

FIGS. 24*a* to 24*c* show a similar embodiment of the lid 8 in accordance with the invention, in which a contact cam 67 is provided in addition to the latching cam 66, wherein the latching cam 66 is lifted upon exertion of a pressure force (arrow in FIG. 24*c*) at one end of the actuating means 6 by the abutment of the contact cam 67 and the actuating means 6 subsequently slides from the closed position to the open position. The illustration of the protrusion 61 and its effects on the closure means 1 were omitted in FIGS. 24*b* and 24*c* for reasons of clarity of the illustration.

Figure 25A:
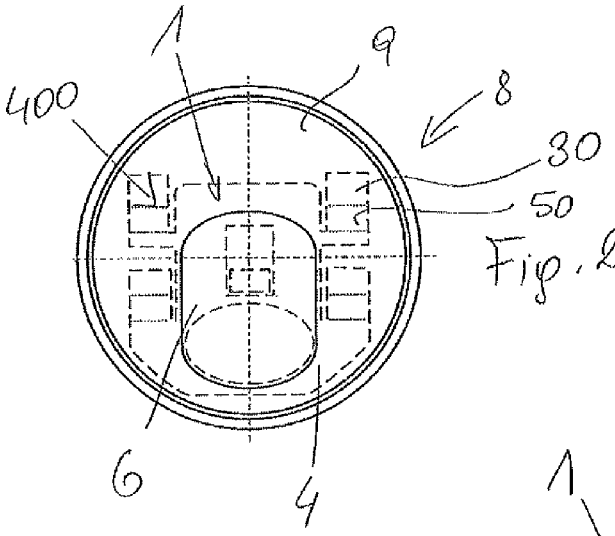
FIGS. 25*a* and 25*b* show an alternative embodiment of the lid in accordance with the invention with a further embodiment of the closure means.
Figure 26:
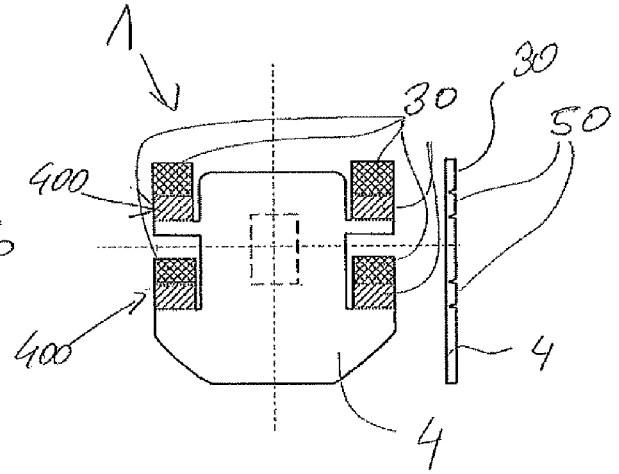
FIG. 26 shows the closure means of FIG. 25*a* and FIG. 25*b* in a top view and in a side view.
Figure 25B:
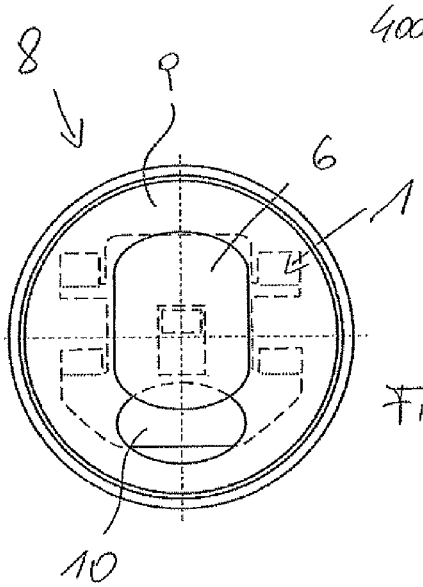

In the variant of the invention as shown in FIGS. 25*a* and 25*b*, a lid 8 is shown with the closure means 1, which on its part is positioned beneath the lid surface 9. Said closure means 1 comprises four recesses 400 which each comprise a fastening area 34 fastening to the bottom side of the lid surface 9 and a lever area 50 which connects the fastening areas 30 with the closure area 4. When the actuating means 6 is moved for opening the beverage can, the closure area 4 moves along a circular orbit, the radius of which corresponds to the length of the lever area 50, with the closure area 4 being aligned parallel to the lid surface 9.

By attaching the usually integral closure means in a non-twistable manner, e.g. by gluing or soldering to the bottom side of the surface of the lid, rapid mounting of the closure means on a conventional lid is possible, wherein no changes or only slight changes are required in the lid, e.g. by simple punching for leading the actuating means through the lid. In particular, the edge region of the lid remains unchanged, so that placing and fastening the lid to the container, and especially the beverage can, can occur in a conventional manner.

It is understood that the embodiments as described above shall be understood in a non-limiting manner for the invention. Especially the shape of the closure means can be adjusted to the respective opening to be closed. The shape of the actuating means is also not limited to the described shapes, but can assume any shape that is suitable for the fixing of the closure means in a position where it is folded away. Furthermore, additional restoring elements can be provided which force the closure means to a closed position.

The invention claimed is:

1. A lid of a container, comprising a substantially flat lid surface and an edge area, with at least one reclosable pouring opening on the lid surface, and a substantially integral closure means on a bottom side of the lid surface, which closure means is associated with the pouring opening and is attached entirely to the bottom side of the lid surface in a twist-proof manner, and an actuating means which is in connection with the closure means, penetrates the lid surface and is arranged accessibly on an upper side of the lid surface, with the closure means being movable from a closed position to an open position through actuation of the actuating means, and with the actuating means comprising a support element which cooperates with the lid surface when the closure means is in the open position, with the closure means being movable to the open position from the closed position substantially perpendicularly to the lid surface and the actuating means covering the pouring opening in the closed position, wherein the actuating means is twistable substantially in one plane parallel to the lid surface, wherein the closure means is a substantially planar plate and comprises a fastening part which is in direct connection with the bottom side of the lid surface in a non-detachable manner, and a closure area which seals the pouring opening in a liquid-tight manner, with a joint being provided between the fastening part and the closure area, about which the closure area of the closure means can be swiveled against a restoring force, and the joint is arranged as an area with increased flexibility disposed between the fastening part and the closure area.

2. The lid according to claim 1, wherein the actuating means is arranged to be twistable on the surface of the lid surface substantially about a central axis extending perpendicularly to the lid surface, and acts on the closure means during twisting so that the closure area is swiveled to the open position.

3. The lid according to claim 1, wherein the joint is arranged as an area made of elastic material which is disposed between the fastening part and the closure area.

4. The lid according to claim 1, wherein the area with increased flexibility is an area with a lower cross section of the material.

5. The lid according to claim 1, wherein the closure means comprises a flexibly resilient material.

6. The lid according to claim 1, wherein the closure means is a two-component injection-molded part.

7. The lid according to claim 1, wherein the actuating element is displaceable on the surface of the lid surface along a path extending parallel to the lid surface, and acts upon the closure means during displacement so that the closure area is swiveled to the open position.

8. The lid according to claim 1, wherein an additional sealing means is arranged between the closure area of the closure means and the lid surface.

9. The lid according to claim 1, wherein the pouring opening is closed off with a seal before the first opening.

10. The lid according to claim 9, wherein the seal is arranged as a pre-punched pull tab which is pulled off during the first opening of the container and exposes the pouring opening in the lid surface.

11. The lid according to claim 1, wherein the pouring opening is sealed before the first opening with the closure means, with the actuating means having a securing device.

12. The lid according to claim 11, wherein the securing device has a predetermined breaking point which is broken open during the first opening of the container.

* * * * *